US006094936A

United States Patent [19]

Miller

[11] Patent Number: 6,094,936

[45] Date of Patent: Aug. 1, 2000

[54] COMBINATION BOTTLED BEVERAGE CHILLER/CADDY AND MINIATURE GOLF CLUB BAG

[75] Inventor: Bruce Miller, Sarasota, Fla.

[73] Assignee: Sport Chef, Inc., Sarasota, Fla.

[21] Appl. No.: 09/221,010

[22] Filed: Dec. 23, 1998

[51] Int. Cl.[7] ..... F25D 3/08

[52] U.S. Cl. ..... 62/457.4; 220/592.36

[58] Field of Search ..... 62/457.3, 457.4, 62/457.8; 220/592.2, 592.25, 592.36

[56] References Cited

U.S. PATENT DOCUMENTS

| | | | |
|---|---|---|---|
| 2,564,165 | 8/1951 | Magis | 62/457.8 |
| 3,760,972 | 9/1973 | McKirnan | 220/592.2 |
| 4,812,054 | 3/1989 | Kirkendall | 62/457.8 |
| 4,964,600 | 10/1990 | Lee | 62/457.4 |
| 5,005,374 | 4/1991 | Spitler | 62/457.3 |
| 5,313,807 | 5/1994 | Owen | 62/457.3 |
| 5,572,792 | 11/1996 | Garabedian | 30/142 |
| 5,974,826 | 11/1999 | Baldwin et al. | 62/457.4 |

*Primary Examiner*—William E. Tapolcai
*Attorney, Agent, or Firm*—Charles J. Prescott

[57] ABSTRACT

A combination miniature golf club bag and bottled beverage chiller positioned centrally in the golf bag. The beverage chiller caddy in the form of the miniature golf bag may be decoratively displayed when not in use, ready to receive a bottled beverage and ice or chilled water for cooling the beverage.

4 Claims, 3 Drawing Sheets

COMBINATION BOTTLED BEVERAGE CHILLER/CADDY AND MINIATURE GOLF CLUB BAG

BACKGROUND OF THE INVENTION

1. Scope of Invention

This invention relates generally to ice buckets and more particularly to a novel combination bottled beverage chiller/caddy and miniature golf bag.

2. Prior Art

Ice buckets which individually contain quantities of ice are well known. These devices, with or without a lid have a sealed container into which the ice cubes are placed surrounded by various arrangements for limiting the thermal conductivity or heat loss from the ice to prolong the useful life of the ice cubes.

These ice buckets may also be sufficiently large and shaped to not only contain a quantity of ice but to also contain a bottled beverage such as wine or champagne positioned within the ice bucket to be surrounded at least partially by pieces of ice.

The shape of a miniature golf bag is disclosed in U.S. Pat. No. 5,572,792 invented by applicant which teaches a combination miniature golf bag and barbecue utensil set. However, this device is not suited for the purpose of containing ice and/or a beverage filled bottle in a fashion which minimizes the loss of chill in the beverage.

The present invention provides such a combination of bottled beverage chiller in combination with a miniature golf bag uniquely configured to provide the appearance and feel of a miniature golf bag for the decorative support and carrying of a bottled beverage with or without ice therearound to enhance chilling.

BRIEF SUMMARY OF THE INVENTION

This invention is directed to a combination miniature golf club bag and bottled beverage chiller positioned centrally in the miniature golf club bag. The beverage chiller/caddy in the form of the miniature golf bag may be decoratively displayed when not in use, ready to receive a bottled beverage and ice or chilled water for cooling the beverage.

It is therefore an object of this invention to provide a combination bottled beverage chiller/caddy having the appearance and feel of a miniature golf club bag.

It is another object of this invention to provide a caddy for carrying a bottled beverage which minimizes chill loss from the beverage in a decoratively configured miniature golf club bag.

It is still another object of this invention to provide a combination bottled beverage container and chiller and a handy decorative caddy in the form of a miniature golf club bag for decorative support and easy portability of the bottled beverage contained therein.

In accordance with these and other objects which will become apparent hereinafter, the instant invention will now be described with reference to the accompanying drawings.

DETAILED DESCRIPTION OF THE INVENTION

Figure 1:
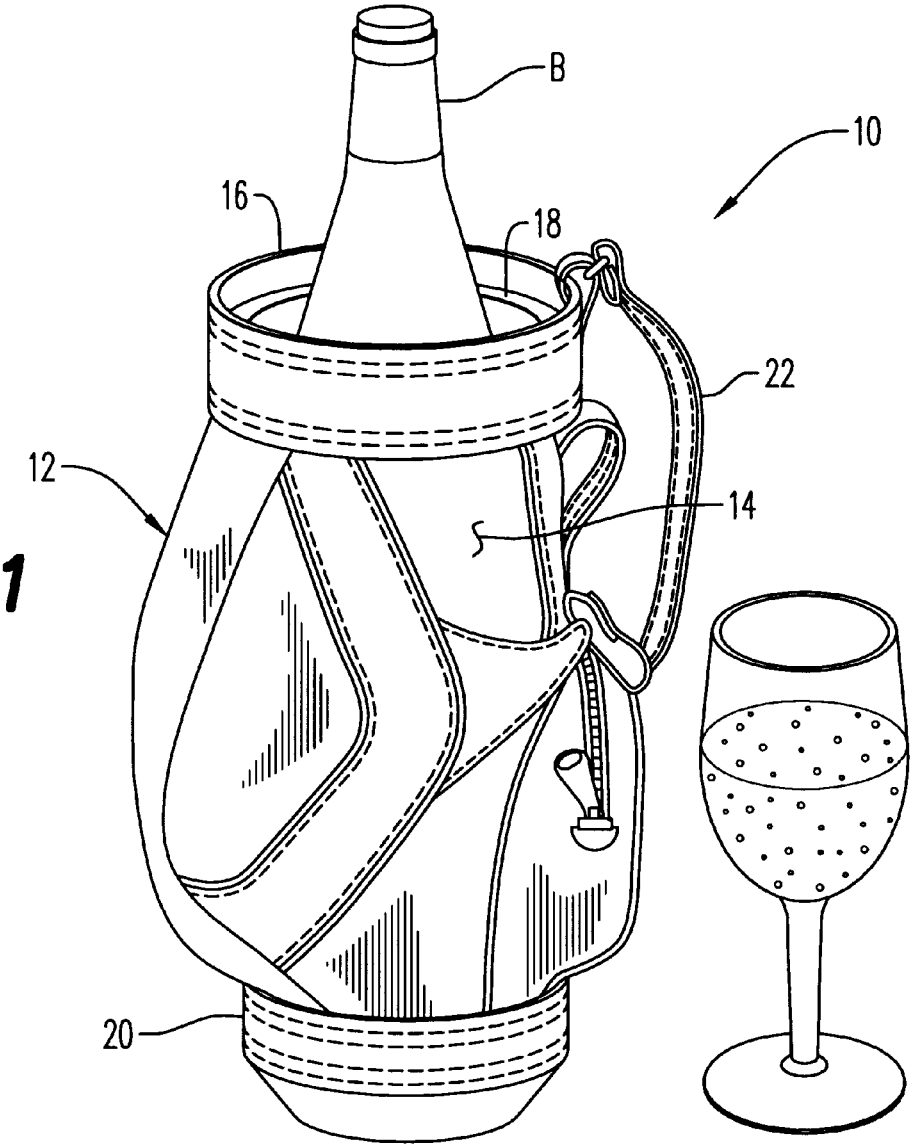
FIG. 1 is a right front perspective view of the invention in use.
Figure 2:
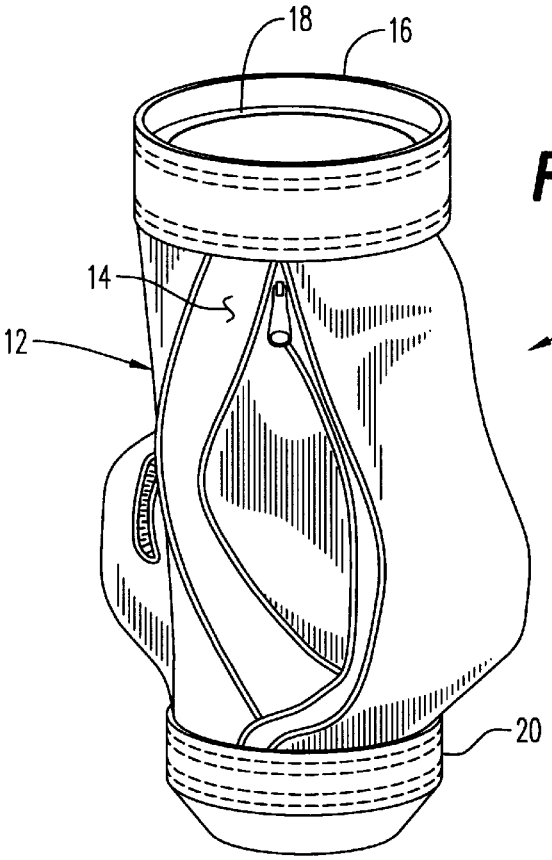
FIG. 2 is a left front perspective view of the invention shown in FIG. 1.
Figure 3:
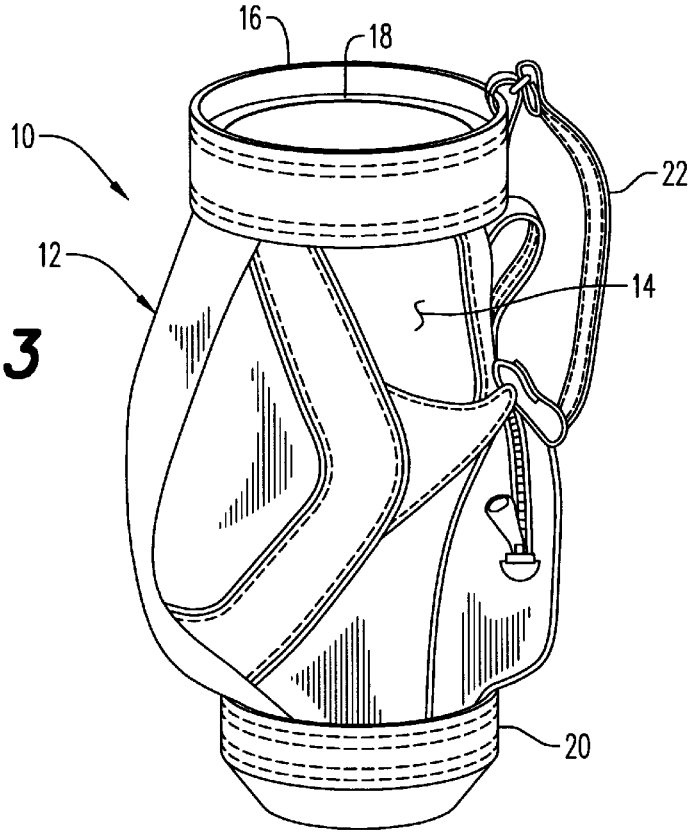
FIG. 3 is another right front perspective view of the invention.

Referring now to the drawings, the invention is generally shown at numeral 10 in all views, the invention 10 generally including a carrying case or caddy 12 in the form of a miniature golf club bag fabricated of pliant vinyl or leather panels shown typically at 14 and having at least one carrying handle 22 so that the device 10 may serve as a caddy or tote. The miniature golf bag 12 also includes a generally circular open upper end 16 and a closed molded bottom or base 20.

Thus, the miniature golf bag 12 may be easily carried or transported by its handle 22 or supported in an upright orientation by its base 20.

Figure 4:
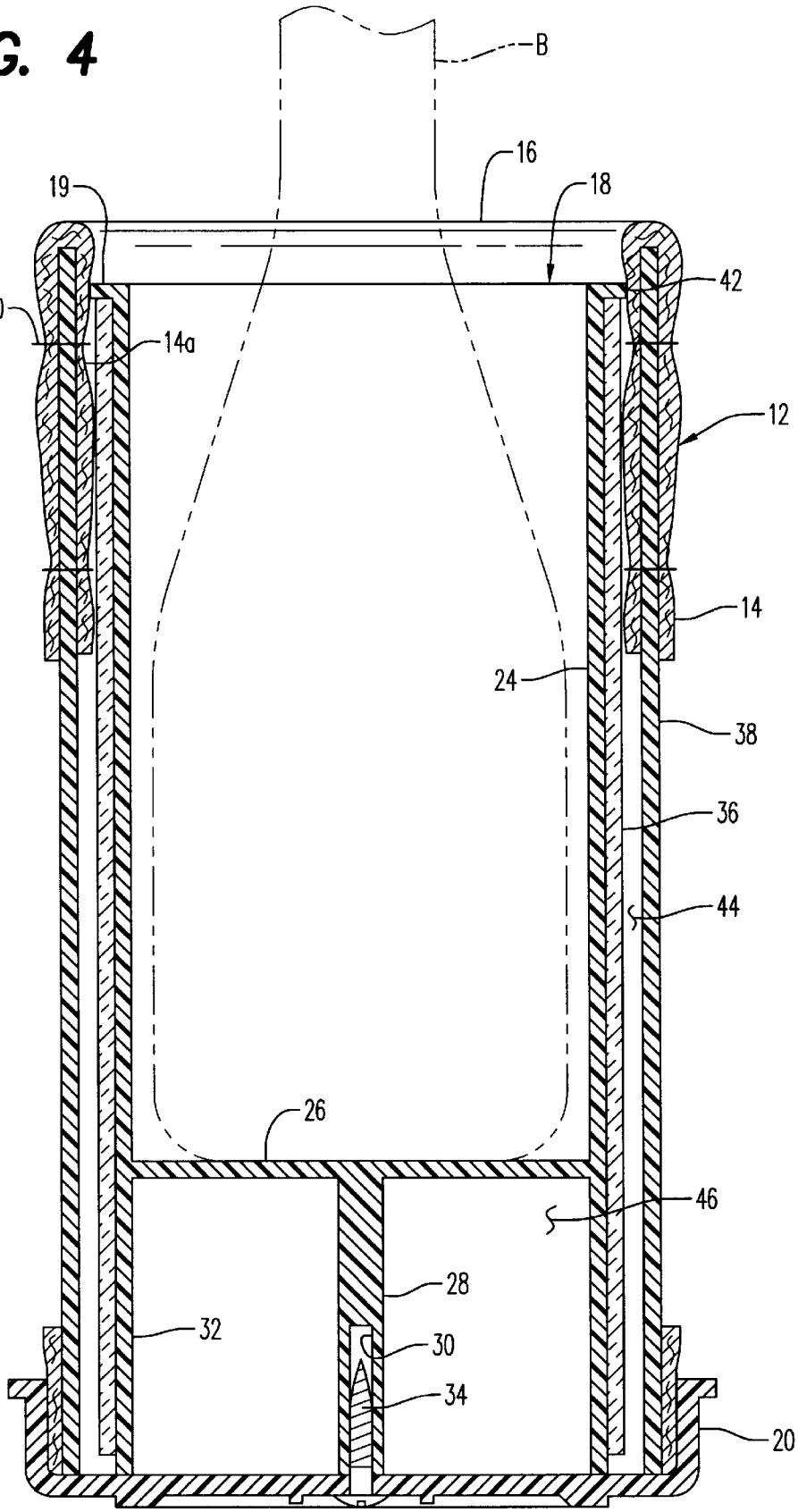
FIG. 4 is a longitudinal section view of the invention showing a bottled beverage in phantom in an in-use position.

The device 10 also includes a molded plastic container 18 having generally uniformly shaped cylindrical walls 24 and 32 and a flanged open upper end 19. The container 18 has a bottom 26 which is positioned above a lower end of the container 18 as best seen in FIG. 4. This bottom 26, in combination with side walls 24 define a closed and sealed cavity for receiving a beverage bottle B as shown in FIGS. 1 and 4. The length of the side wall 24 is sufficient to extend along substantially the entire length of the main body of a typical beverage filled bottle B so as to more efficiently prevent loss of the chill in the beverage within the bottle B and/or to enhance the efficiency of cooling the beverage with ice within the container surrounding the bottle (not shown).

The upper flanged opening 19 is sized to snugly fit within the somewhat pliant upper opening 18 of the miniature golf bag 12 so as to prevent water or ice from getting between the container 18 and the inner surfaces of the miniature golf bag 12. To decoratively and functionally enhance the upper portion of the miniature golf bag, a folded over layer of pliant material 14 is secured in place by stitching 40 so as to encapsulate all of the outer surface of a tubular support member 38 which is sized slightly larger in diameter than that of the container 18.

Completely surrounding the outer cylindrical surface of the container 18 is a thin layer of pliant insulating material 36. This insulating material 36 extends over substantially the entire length and outer surface of the container 18, including the lower side walls 32, down to the lower end thereof.

An air gap 44 is defined between the insulation layer 36 and the tubular support member 38. This air gap 44 is established to further reduce the thermal conductivity of the multi-layer wall section starting with the container wall 24 extending radially out to the pliant golf bag panel 14.

A separate air chamber 46 is also provided between the bottom 26 of the container 18 and the lower end of the container 18 which rests atop bottom 20. A central attaching peg 28 having a lower central cavity 30 receives a conventional threaded fastener 34 passed through a central mating hole in the bottom 20 to secure the container 18 in the position shown in FIG. 4.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In combination, a bottled beverage chiller and a miniature golf club bag comprising:

a miniature golf club bag having a main upright elongated body open at an upper end thereof, a base for supporting said golf club bag in an upright orientation atop a surface and a carrying strap;

an upright bottled beverage container having an open upper end and a bottom and secured within said golf club bag and extending downwardly from said golf club bag open upper end into and along substantially a length of said golf bag, a lower end of said container supported atop said base;

said container sized in width and length to supportively receive a beverage bottle and a quantity of ice positionable around the beverage bottle in said container;

an insulation layer wrapped around said container and generally coextensive therewith.

2. A bottled beverage chiller and miniature golf club bag as set forth in claim 1, further comprising:

a substantially tubular support member open at each end thereof connected to, and substantially coextensive with, an inner surface of said body, said support member for stiffening said body and for decreasing the thermal conductivity of said container.

3. A bottled beverage chiller and miniature golf club bag as set forth in claim 2, wherein:

said tubular support is spaced radially outwardly from said insulation layer to define an air gap therebetween to further decrease the thermal conductivity of said container.

4. A bottled beverage chiller and miniature golf club bag as set forth in claim 3, wherein:

said bottom is spaced upwardly from said container lower end to provide a second air gap therebetween to still further decrease the thermal conductivity of said container.

* * * * *